US005405179A

United States Patent [19]

Jih

[11] Patent Number: 5,405,179

[45] Date of Patent: Apr. 11, 1995

[54] ELASTIC SEAT PAD

[76] Inventor: Jong-shyong Jih, No. 2, Alley 15, Lane 155, Gong-shyue Load, Taichung, Taiwan, Prov. of China

[21] Appl. No.: 207,314

[22] Filed: Mar. 7, 1994

[51] Int. Cl.[6] ..... A47C 7/35

[52] U.S. Cl. ..... 297/452.49; 5/241; 5/476; 267/133; 297/452.42; 297/452.45; 297/452.63

[58] Field of Search ..... 297/452.42, 452.45, 297/452.48, 452.49, 452.54, 452.56, 452.63; 5/238, 241, 476; 267/131, 133

[56] References Cited

U.S. PATENT DOCUMENTS 2,807,809 10/1957 Kottemann ..... 297/452.45 X
4,638,517 1/1987 Yang et al. ..... 5/238 X

FOREIGN PATENT DOCUMENTS 3232123 3/1984 Germany ..... 5/238
149246 4/1921 United Kingdom ..... 5/238
472664 9/1937 United Kingdom ..... 297/452.63

*Primary Examiner*—Peter R. Brown
*Attorney, Agent, or Firm*—Pro-Techtor International

[57] ABSTRACT

An elastic seat pad comprises a protective covering, a cushion of coconut filament, an elastic layer, and a support plate. The elastic layer is of a framelike construction and provided respectively in two opposite inner frame surfaces thereof with a trapezoid having a plurality of slots dimensioned to receive both ends of elastic tubes. The elastic layer is further provided peripherally in the outer frame surfaces thereof with a plurality of through holes dimensioned to receive therein respectively an elastic block for giving an added elasticity to the periphery of the seat pad. The elastic tubes are mounted in the elastic layer such that the elastic tubes are further supported by a plurality of bracing blocks of an archlike construction.

5 Claims, 4 Drawing Sheets

ELASTIC SEAT PAD

BACKGROUND OF THE INVENTION

The present invention relates generally to a seat pad, and more particularly to an elastic and breathable seat pad.

The conventional seat pad is generally made of a unitary foam sponge body enclosed in a protective cover of strong cloth or other fabric. The foam sponge body absorbs easily the heat of a human body and is poor at radiating the heat it has absorbed. In addition, the foam sponge body is devoid of an excellent elasticity. The improvement in the elasticity of the conventional seat pad by a coiled spring is economically infeasible.

SUMMARY OF THE INVENTION

It is therefore the primary objective of the present invention to provide an elastic seat pad with an excellent elasticity. The elastic seat pad is made up of a protective covering, a cushion of coconut filament, an elastic layer, a support plate, and a plurality of elastic tubes, bracing blocks and elastic blocks. The elastic layer is of a framelike construction and provided with a plurality of slots and oval through holes. The elastic tubes are mounted in the elastic layer such that the elastic tubes are supported by the bracing blocks, and that the elastic tubes and the bracing blocks are suspended in the elastic layer to provide the seat pad with excellent elasticity and breathing effect. It is another objective of the present invention to provide an elastic seat pad with a plurality of elastic tubes and bracing blocks. The elastic tubes are made of a carbon fiber material while the bracing blocks are made of a plastic material. The elastic tubes are therefore resistant to deformation under pressure.

In the meantime, the bracing blocks give an added elasticity and support to the elastic tubes under pressure.

Upon being relieved of the pressure, the seat pad of the present invention is therefore capable of recovering completely its original shape.

It is still another objective of the present invention to provide an elastic seat pad with an elastic layer of a framelike construction and having peripherally a plurality of through holes, into each of which an elastic block is inserted for enhancing the elasticity of the elastic layer of the seat pad.

The foregoing objectives, structures, features and functions of the present invention will be more readily understood by studying the follwing detailed description of the present invnetion in conjunction with the drawings provided herewith.

DETAILED DESCRIPTION OF THE INVENTION

Figure 1:
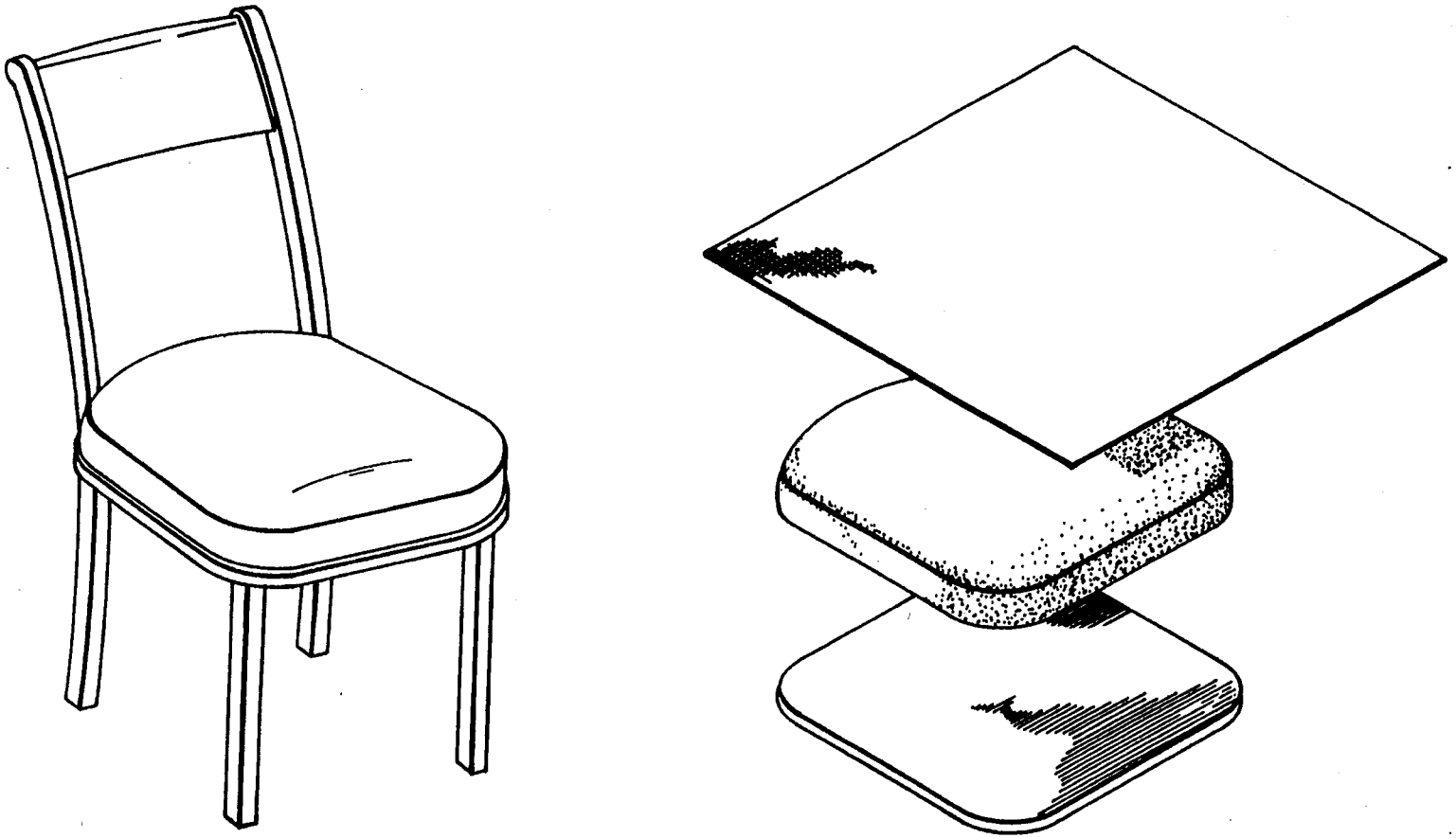
FIG. 1 PRIOR ART
FIG. 1 shows a perspective exploded view of a seat pad of the prior art.
Figure 2:
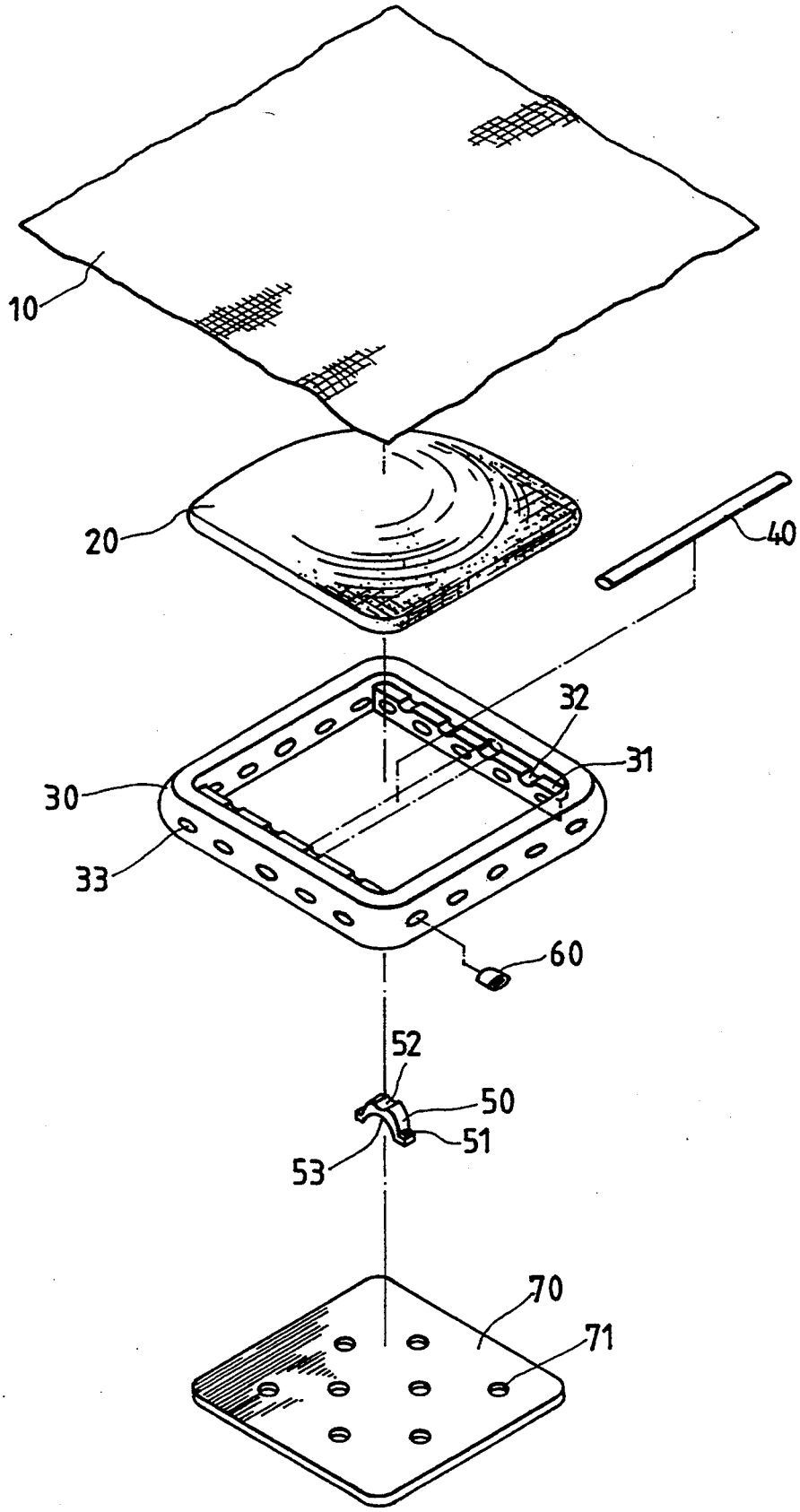
FIG. 2 shows an exploded view of a seat pad of the present invention.
Figure 3:
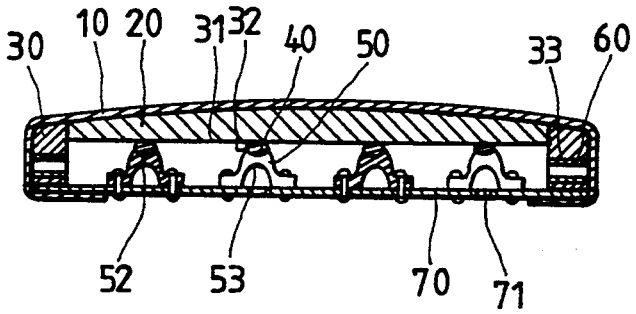
FIG. 3 shows a sectional schematic view of the seat pad in combination, according to the present invention.
Figure 4:
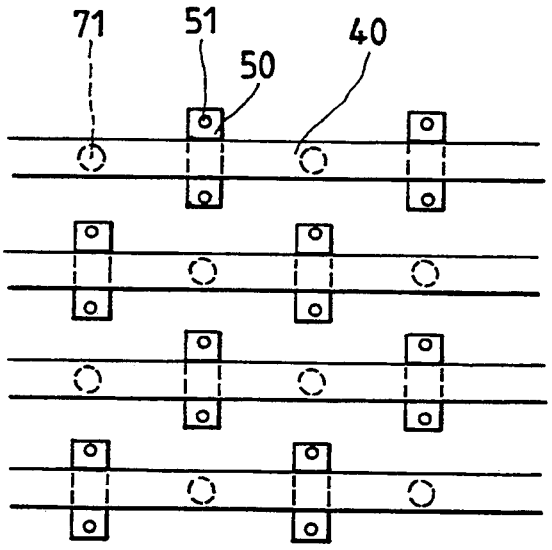
FIG. 4 is a schematic view showing the constructional relationship among the elastic tubes, the bracing blocks and the support plate, according to the present invention.
Figure 5:
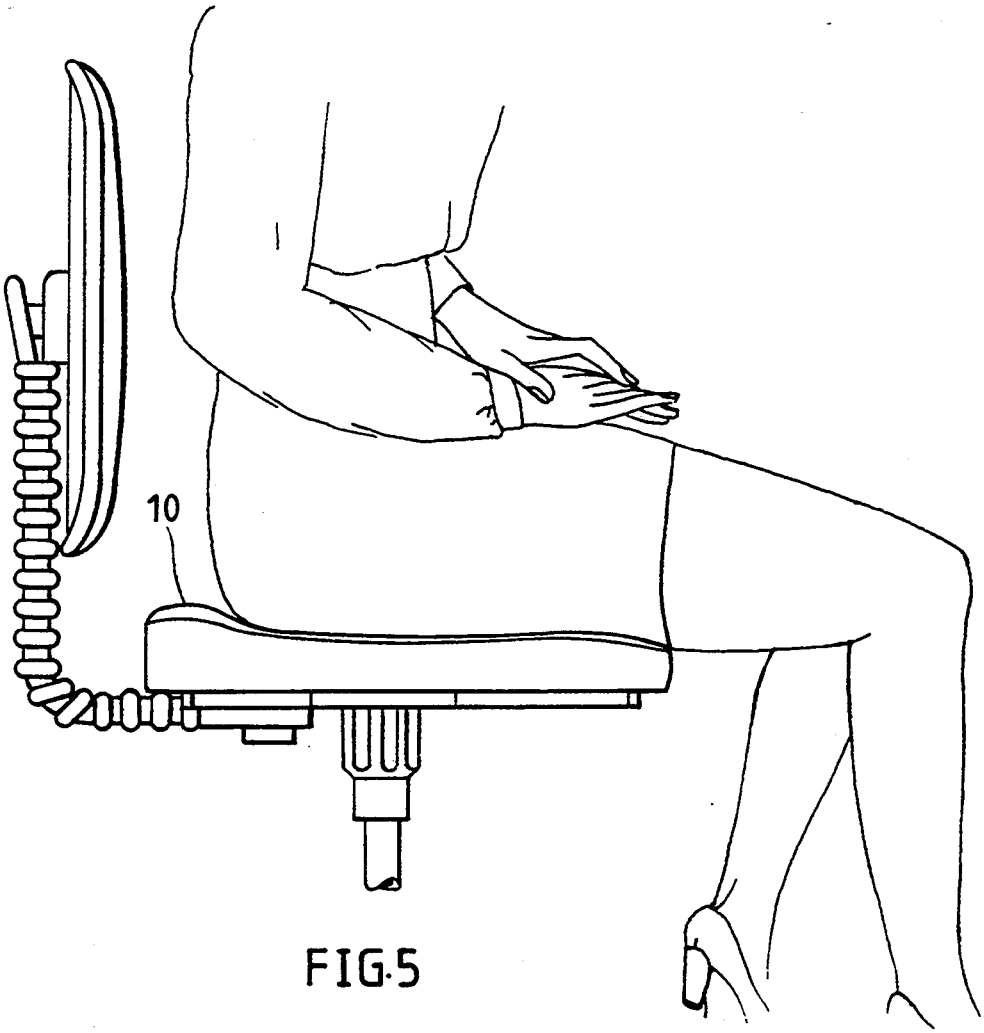
FIG. 5 shows a schematic view of the seat pad at work, according to the present invention.
Figure 6:
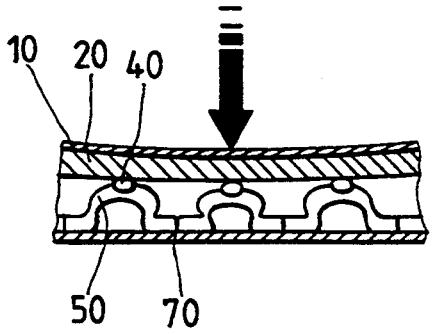
FIG. 6 shows a sectional schematic view of the seat pad at work, according to the present invention.

As shown in FIG. 2, the seat pad of the present invention comprises a protective covering 10, a cushion 20 of coconut filament, an elastic frame 30, a plurality of elastic tubes 40, bracing blocks 50 and elastic blocks 60, and a support plate 70. The elastic frame 30 of a foam material is of a framelike construction and provided respectively in two opposite inner frame surfaces thereof with a mounting block 31 having a plurality of slots 32. The outer frame surface of the elastic frame 30 is provided with a plurality of through holes 33 of oval construction. Each of the elastic tubes 40 is of hollow construction and has an oval cross section. Each of the bracing blocks 50 is of an archlike construction and provided respectively at both ends thereof with a connecting hole 51 and at the bottom thereof with a hollow arcuate portion 53. Each of the elastic blocks 60 is similar in shape to the through hole 33 of the elastic frame 30 and is of a hollow construction. The support plate 70 is provided with a plurality of holes 71 which are arranged alternately. Each of the bracing blocks 50 is arranged on the support plate 70 for supporting the elastic tube 40 mounted in the slots 32 of the elastic frame 30. Attached to the top surface of the elastic frame 30 is the cushion 20 of coconut filament, which is in turn covered thereon with the protective covering 10. The seat pad of the present invention described above is provided with an excellent elasticity and a good breathing effect, thanks to the elastic tubes 40 and the bracing blocks 50 which are suspended in the elastic frame 30. Each of the elastic tubes 40 is made of a carbon fiber material while each of the bracing blocks 50 is made of a plastic material. The elastic tubes 40 are provided with an excellent elasticity and are resistant to deformation.

When the elastic tubes 40 ;are exerted on by the weight pressure of a person seating on the seat pad of the present invention, the bracing blocks 50 art to give an added support and elasticity to the elastic tubes 40, thereby enabling the seat pad of the present invention to recover its original shape after being relieved of the weight pressure. In addition, the seat pad of the present invention is provided peripherally with an excellent elasticity in view of the fact that the through holes 33 of the elastic frame 30 are provided therein respectively with the elastic blocks 60 of a plastic material.

The embodiment of the present invention described above is to be regarded in all respects as merely illustrative and not restrictive. Accordingly, the present invention may be embodied in other specific forms without deviating from spirit thereof. The present invention is therefore to be limited only by the scope of the following appended claims.

What is claimed is:

1. An elastic seat pad comprising:

a protective covering;

a cushion;

an elastic frame element;

a support plate with multiple ventilating holes; wherein said elastic frame includes mounting blocks on inner surfaces of two opposing sides of the elastic frame, each mounting block including a plurality of depressions on upper surfaces thereof which receive ends of multiple hollow elastic tubes, the frame further including a plurality of through holes which receive elastic blocks, and said support plate is affixed to an underside of said elastic frame such that bracing blocks affixed to an upper surface of said support plate support said elastic tubes, the elastic tubes in turn supporting the cushion, and said protective covering covers said cushion.

2. The elastic seat pad of claim 1 wherein:

said elastic tubes are made from a carbon fiber material, thereby being resistant to deformation.

3. The elastic seat pad of claim 1 wherein:

said bracing blocks are made from a plastic material.

4. The elastic seat pad of claim 1 wherein:

said elastic blocks are made from a plastic material.

5. The elastic seat pad of claim 1 wherein:

said elastic frame is made from a foam material.

* * * * *